United States Patent [19]

Goldmann

[11] 4,409,082

[45] Oct. 11, 1983

[54] METHOD AND APPARATUS FOR THE GALVANIC DEPOSITION OF METAL ONTO OBJECTS, CLEANING OFF AND RECOVERY OF ADHERENT SURFACE TREATMENT AGENTS

[75] Inventor: Helmut Goldmann, Rannersdorf, Fed. Rep. of Germany

[73] Assignee: Schering AG, Berlin and Bergkamen, Fed. Rep. of Germany

[21] Appl. No.: 357,551

[22] Filed: Mar. 12, 1982

[30] Foreign Application Priority Data

Feb. 20, 1981 [DE] Fed. Rep. of Germany ..... 3107101

[51] Int. Cl.[3] ..... C25D 17/00

[52] U.S. Cl. ..... 204/213; 204/13; 204/200; 204/201; 204/275; 204/277; 204/278

[58] Field of Search ..... 204/213, 275, 278, 277, 204/200, 201, 13

[56] References Cited

U.S. PATENT DOCUMENTS

| | | | |
|---|---|---|---|
| 1,429,170 | 9/1922 | Severance | 204/213 |
| 1,618,199 | 2/1927 | Hulmer | 204/213 |
| 3,607,712 | 9/1971 | Barton | 204/201 |
| 4,129,494 | 12/1978 | Norman | 204/275 |
| 4,151,062 | 4/1979 | Norris | 204/275 |
| 4,153,531 | 5/1979 | Faul et al. | 204/275 |
| 4,337,135 | 6/1982 | Quinton et al. | 204/213 |

*Primary Examiner*—Arthur P. Demers
*Attorney, Agent, or Firm*—Michael J. Striker

[57] ABSTRACT

Apparatus for the electrolytic deposition of metal onto metallic or appropriately pre-treated non-metallic objects and cleaning these objects of adhering surface treatment agents after further treatment as well as recovery of these treatment agents, with treatment station, drum installation, anodes, work container, supply bin, rotating arrangement, dosing and measuring arrangements, electrical attachments as well as connected conduit tubes, thereby characterized in that in the work container with overflow arrangement, two anodes are semicircularly arranged around the drum aggregate, whereby the work container is connected across an opening with fractionating arrangement, to a supply container with vacuum space for the surface treatment agent, which can be adjusted to a reduced pressure by means of a vacuum arrangement, and whereby the supply container is connected across a recirculation conduit to the work container, as well as a method using this apparatus. With current density up to 20.0 A/dm$^2$, layer thickness from 25 to 30 μm can be obtained, with quantitative recovery of the electrolyte in a closed circulation.

17 Claims, 2 Drawing Figures

METHOD AND APPARATUS FOR THE GALVANIC DEPOSITION OF METAL ONTO OBJECTS, CLEANING OFF AND RECOVERY OF ADHERENT SURFACE TREATMENT AGENTS

BACKGROUND OF THE INVENTION

The invention concerns an apparatus and a method for the electrolytic deposition of metal onto metallic and appropriately pre-treated non-metallic objects, and cleaning off of these objects adhering surface treatment agents, as well as recovery of these agents, using a treating station, drum aggregate, anodes, work container, supply bin, rotating arrangement, vacuum arrangement, dosing and measuring arrangements, electrical accessories as well as connected conduit tubes.

Apparatus and methods for the electrolytic deposition of metal onto objects, their cleaning as well as recovery of the treatment agent used, are already known.

These known apparatus and methods are, however, always utilizable only for one or also two of these functions. Their use in a closed system is possible either not at all or only with unsatisfactory effectiveness.

SUMMARY OF THE INVENTION

It is therefore an object of the present invention to provide an apparatus and a method which makes possible a electrolytic deposition of metal onto objects, their cleaning off of adhering surface treatment agents, as well as recovery of the agents, in a closed circulation.

This object is attained according to the present invention through an apparatus of the above-designated type, which is thereby characterized in that in the work container with overflow arrangement, two anodes are disposed semicircularly around the drum aggregate, with the work container connected, across an opening with fractionating arrangement, with a supply bin for the surface treatment agent, which by means of a vacuum arrangement can be adjusted to a reduced pressure, and in which this supply bin is connected to the work container across a recirculation conduit.

Preferred embodiments of the apparatus according to the present invention include:

- that the drum aggregate is provided with seals, preferably in the form of moldings, which produce a narrow connection between drum and anodes,
- that the work container is provided with a waterjet arrangement,
- that the work container is provided with a blower,
- that the apparatus has an automatic regulating system for control of current as well as dosing arrangement regulated by means of an ampere-hour meter, and
- that the apparatus is arranged in an automatic arrangement including conveying devices, bath container, recovery means, connected conduit tubes, and control system.

The object of the present invention is moreover attained through a method of the above-described type, which is thereby characterized in that the object which is pre-treated in customary manner, is initially galvanized in a drum aggregate located between anodes arranged semicircularly, after filling with a bath solution from a supply bin, whereby the bath solution is continuously sucked off across a clearance formed by the ends of the anodes, from the work container into the supply bin, and led back over connected conduit tubes into the work container, to supplement the consumed bath solution, until the galvanization is finished, whereupon after switching off of the anode current, the supply of the bath solution is discontinued, and this bath solution is then sucked from the work container and from the galvanized object, until the removal thereof is as complete as possible.

Preferred embodiments of this method include,

- that the filling of bath solution, from the supply bin into the work container, follows by means of a rotating arrangement,
- that an overfilling of the work container with the bath solution is avoided through a safety overflow, which leads this solution back into the supply bin,
- that the galvanization is begun with an initial current of about 0.1 $A/dm^2$,
- that the galvanization follows at a nominal value of about 8 to 10 $A/dm^2$,
- that the sucking off operation follows with a reduced pressure from about 40 to 4000 mm hydrostatic head,
- that after galvanization and cleaning of the object, a rinsing operation is provided, with which instead of bath solution, pure water is sucked through the drum aggregate for complete cleaning of the object in an amount which restores loss of water arising through evaporation in the supply bin, and
- that the drying of the object is performed by means of a gas stream, preferably air, which is led through the drum aggregate upon the objects located therein, by means of a blower.

The apparatus and the method according to the present invention can be used for all electrolytic surface treatment techniques, with which a cleaning and a recovery of the aqueous surface treatment agent still adhering to the object after further treatment, is either necessary or desirable.

The apparatus and the method are suitable therefor in particular for electrolytic deposition of chromium, nickel, cobalt, copper, cadmium, zinc, tin, lead, silver, gold, rhodium, palladium and their alloys, with which an economical usage and environmental necessity presuppose an as quantitative as possible recovery of the raw materials.

These objects, previously realizable by no apparatus and no known method, are now attained with the apparatus and the method of the present invention in excellent manner, in that they make possible the electrolytic deposition of metal onto objects, their cleaning and the quantitative recovery of treatment agent naturally adhering to the objects after their treatment, in a closed system.

The particular advantages of the method according to the present invention include among others the direct recovery and prompt re-use of the employed surface treatment agents. Through smallest requirement of rinsing agent and almost complete omission of condensation and waste water treatment techniques, the result is generally very low operational costs.

The apparatus according to the present invention is more closely described as follows:

A customary drum with perforated walls serves as drum aggregate, which component is a complete drum carrier and rests between two supporting arms.

The drum aggregate is preferably provided with seals, advantageously in the form of moldings, which produce a narrow connection between drum body and the anodes, which enclose the drum body semicircularly. The clearance between the anodes, through which the bath solution is sucked off, is adjusted as small as possible. This type of arrangement makes possible an operation with less voltage, whereby energy is saved.

As anode material, are employed metals corresponding to the electrolyte used, that is, soluble anodes with electrolytes based upon zinc, copper, silver, cadmium, nickel, among other metals, insoluble anodes with electrolytes based upon gold, chromium, among others.

The drum aggregate is disposed in a work container, which has been filled with the operational electrolyte, to such an extent that the drum is constantly covered during the electrolytic deposition of metal. An overflow arranged at the side in the work container, prevents an overflowing of the container.

The work container is moreover provided with a rinsing or washing arrangement. In addition, a blower can be installed for dry-blowing.

The continuous supply of electrolyte into the work container follows by means of a rotating arrangement, from the supply bin across a recirculation conduit. Through insertion of filter units, an intensive filtration of the electrolyte is simultaneously obtained.

The rotating arrangement is appropriately arranged in a compartment with heating and bath adjustment, separated spatially from the supply bin, whereby both containers naturally are so connected that an unhindered electrolyte flow can follow.

The supply bin for the electrolyte is simultaneously formed as a vacuum chamber, which is obtained through connection of a vacuum arrangement, such as for example, a single-step radial ventilator, a multi-stage blower, or a vacuum pump. In this vacuum arrangement, there can expediently be installed an evaporator or drop separator, in order to hold the electrolyte volume constant.

This vacuum chamber guarantees a strengthened electrolyte flowthrough, that is an intensive exchange of electrolyte in the interior of the drum and thereby on the objects.

This has the great advantage that the current density of 1.0 to 2.0 $A/dm^2$, obtainable as a rule with the knon apparatus and method, in surprising manner can be increased up to 20.0 $A/dm^2$, and thereby the exposure time can be considerably abbreviated.

Layer thicknesses of, namely, about 25 to 30 $\mu m$ can be obtained, whereas the known method, in a similar period of time, makes possible layer thicknesses of about 12 $\mu m$.

In spite of these enormous current densities, the so-called "scorch effect", otherwise usual herewith, does not occur on the articles, but to the contrary, coatings of higher quality are produced.

The washing arrangement put in operation in the work container makes possible a problem-free after-flushing of the objects after ensuing sucking off of the electrolyte, whereby an optimal cleaning is made possible. In case desired, the object can then be dried by sucking through of air or blowing in of air, by means of a blower.

A fractionating apparatus disposed in the upper part of the supply bin, which serves on the one hand to close the work container, for example upon first filling this container with electrolyte solution, can on the other hand also be used for fractionating different surface treatment agents with insertion of several treatment stages.

As raw material for the apparatus according to the present invention, the customary materials can be used, so far as they are stable in the presence of the surface treatment agents to be sucked off, and do not disturb the surface treatment process. In general, synthetic resin plastics or plastic-coated metals are used.

The controlling of the apparatus can follow through an electronic system. The apparatus itself can be composed of an automatic plant embracing conveying arrangements, bath container, recovery means, connected conduit tubes and control systems.

The performance of the method according to the present invention is technically problem-free.

The sucking off of the treatment agents follows through reduced pressure. The sucking force advantageously lies between 40 and 4000 mm hydrostatic head, and can be adjusted across a regulating arrangement, for example throttling, draft flap controlling, or rotational speed alteration with the reduced pressure generator, depending upon the actual requirements in each case.

The attainment of the reduced pressure up to about 1200 mm hydrostatic head is advantageously accomplished with a single-stage radial ventilator. In the range up to 3500 mm hydrostatic head, multiple-stage blowers are used. In work ranges lying above these values, vacuum pumps are expediently used.

The apparatus and the method according to the present invention make possible in a closed system with continuous manner of operation, an outstanding electrolytic deposition of metal in the shortest treatment period, the quantitative recovery of the treatment agents adhering to the objects, and the cleaning of the objects, to an extent which guarantees the quick insertion of the objects without after-treatment.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. I shows the apparatus according to the present invention in front sectional view. The reference numerals indicate the following components:

(1) drum aggregate
(2) anodes
(4) supply bin with electrolyte and vacuum chamber (3)
(7) washing arrangement (rinsing) and/or blower
(8) evaporator
(9) place of attachment for vacuum arrangement
(10) fractionating arrangement
(11) overflow arrangement.

Figure 2:
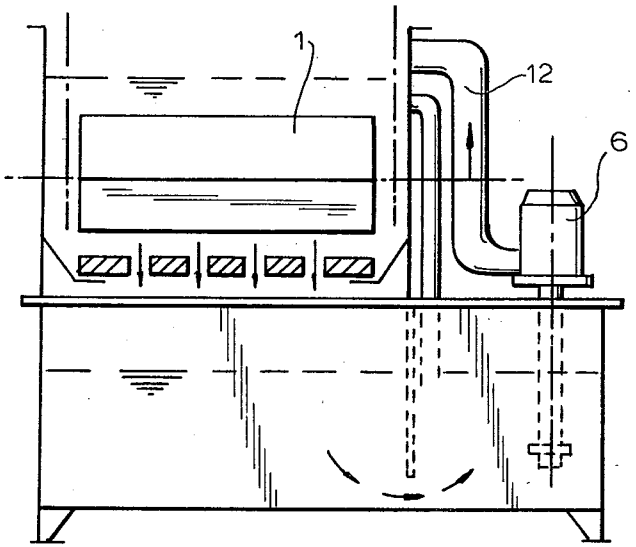
Figure 1:
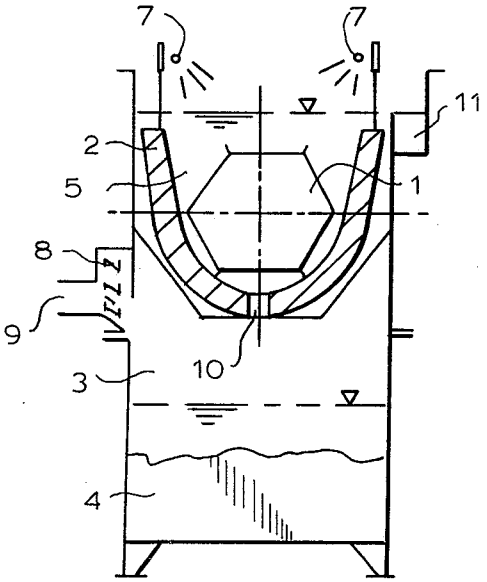

FIG. II shows a side view of the apparatus according to the present invention. The reference numerals indicate:

(1) drum aggregate
(6) rotating arrangement
(12) recirculation conduit.

DESCRIPTION OF THE PREFERRED EMBODIMENTS

The drum aggregate (1) is filled half way with loose goods (small parts) which have been pre-treated in customary manner, that is, degreased by heat, scoured, degreased, pickled and subsequently inserted into the work container with an automatically controlled conveying arrangement.

The rotating arrangement then transports the electrolyte, for example on the basis of a nickel bath, from the supply bin into the work container, until the drum body is completely covered with electrolyte solution.

Upon reaching the highest bath level, the fractionating arrangement opens, whereby the electrolyte circulation begins. An overfilling of the work container is avoided by means of the overflow arrangement.

Initially, the starting current of about 0.1 $A/dm^2$ is adjusted through an automatically regulated current step selection. As soon as the maximum electrolyte exchange is reached, the current intensity is brought stepwise within about 3 minutes to the nominal value of about 8 $A/dm^2$ to 10 $A/dm^2$.

When the work container is completely flooded, the vacuum arrangement is placed into operation.

After opening of the fractionating arrangement, the electrolyte flows through the vacuum chamber back into the supply bin, and from there across the recirculation conduit, anew into the work container. The hydrogen produced during operation is herewith continuously sucked off, and hereby a so-called "scorching" of the work piece is avoided.

After an exposure period of about 15 minutes, during which a layer thickness on the average of 12 $\mu m$ can be obtained, the metallization process is terminated, whereupon the rotating pump is disconnected by means of a regulating system. The electrolyte flows from the work chamber back into the supply container. The treating agent still adhering to the object is sucked off as completely as possible and likewise flows back into the supply device.

Thereafter, by means of the washing or rinsing arrangement, pure water is brought into the working space, and sucked through the drum aggregate, whereby the complete cleaning of the small parts ensues. This presentation of water can advantageously follow in intervals, and indeed in amounts which restore the loss arising through evaporation.

Subsequently, a complete drying of the object is annexed, through blowing in of gas, preferably air, by means of the blower.

The object, cleaned of surface treatment agent, is then after removal from the drum aggregate of the work space, conveyed to its further utility.

It will be understood that each of the elements described above, or two or more together, may also find a useful application in other types of electrolytic processes differing from the types described above.

While the invention has been illustrated and described as embodied in a method and apparatus for the electrolytic deposition of metal onto objects, and cleaning off and recovery of adherent surface treatment agents, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. Apparatus for the electrolytic deposition of metal onto metallic and appropriately pretreated non-metallic objects, and cleaning these objects of adhering surface treatment agents, as well as recovery of these agents, provided with treatment station, drum installation, anodes, work container, supply bin, rotating arrangement, dosing and measuring arrangements, electrical attachments as well as connected conduit tubes, comprising two anodes semicircularly disposed around the drum installation in the work container with overflow arrangement, with the work container connected to a supply bin across an opening with fractionating arrangement, which container and bin can be adjusted to a reduced pressure by means of a vacuum arrangement, and with the supply bin connected to the work container over a recirculation conduit.

2. Apparatus according to claim 1, further comprising seals provided in the drum installation, which produce a close connection between drum and anodes.

3. Apparatus according to claim 2, wherein said seals are in the form of moldings.

4. Apparatus according to claim 1, further comprising a rinsing arrangement provided in the work container.

5. Apparatus according to claim 1, further comprising a blower provided in the work container.

6. Apparatus according to claim 1, further comprising an automatic regulating system for current control as well as a dosing arrangement regulated by means of an ampere-hour meter.

7. Apparatus according to claim 1, arranged in an automatic arrangement including conveying means, bath container, recovery means, connected conduit tubes and control systems.

8. Method for the electrolytic deposition of metal onto objects and cleaning adhering surface treatment agents off of these objects, as well as recovery of these surface treatment agents, comprising initially galvanizing a customarily pretreated object in a drum arrangement contained between anodes arranged semicircularly after filling said drum arrangement with a bath solution from a supply bin, with the bath solution being continuously sucked off across a clearance formed by ends of the anodes, from the work container into the supply bin, and led back across connected conduit tubes into the work container to supplement consumed bath solution, until galvanizing is finished, whereupon after switching off anode current, supply of bath solution is discontinued and bath solution is sucked from the work container and from the galvanized object until removal of the bath solution is as complete as possible.

9. Method according to claim 8, wherein said filling with bath solution from the supply bin to the work container follows by means of a rotating arrangement.

10. Method according to claim 8, wherein an overfilling of the work container with the bath solution is avoided by means of a safety overflow, which leads the solution back into the supply bin.

11. Method according to claim 8, wherein the galvanization is begun with an initial current of about 0.1 $A/dm^2$.

12. Method according to claim 8, wherein the galvanization follows at a current from about 8 to 10 $A/dm^2$.

13. Method according to claim 8, wherein the sucking off follows with a reduced pressure of about 40 to 4000 mm hydrostatic head.

14. Method according to claim 8, further comprising rinsing after galvanization and cleaning of the object, with which instead of bath solution, pure water is sucked through the drum installation for complete cleaning of the object in an amount which restores loss of water arising through evaporation in the supply bin.

15. Method according to claim 14, further comprising drying the object by means of a gas stream led through the drum installation, upon the object located therein, by means of a blower.

16. Method according to claim 15, wherein said gas is air.

17. Method according to claim 8, for deposition of lead, chromium, gold, cadmium, cobalt, copper, nickel, silver, rhodium, palladium, zinc, tin or their alloys.

* * * * *